US006450896B1

(12) United States Patent
Chen

(10) Patent No.: US 6,450,896 B1
(45) Date of Patent: Sep. 17, 2002

(54) HEAD OF A WOODEN GOLF CLUB

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 09/590,256

(22) Filed: Jun. 9, 2000

(51) Int. Cl.[7] ..... A63B 53/04; A63B 53/06; A63B 53/08

(52) U.S. Cl. ..... 473/324; 473/305; 473/334; 473/345

(58) Field of Search ..... 473/305, 345, 473/340

(56) References Cited

U.S. PATENT DOCUMENTS 4,768,787 A * 9/1988 Shira ..... 273/175
5,094,383 A * 3/1992 Anderson et al. ..... 228/176
5,433,440 A * 7/1995 Lin ..... 273/78
5,720,673 A * 2/1998 Anderson ..... 473/342
5,961,394 A * 10/1999 Minabe ..... 473/305
6,203,448 B1 * 3/2001 Yamamoto ..... 473/338

* cited by examiner

*Primary Examiner*—Paul T. Sewell
*Assistant Examiner*—Sneh Varma
(74) *Attorney, Agent, or Firm*—Browdy and Neimark, P.L.L.C.

(57) ABSTRACT

A golf club head is formed of a metal shell, a metal neck tube, and a metal ball-hitting plate. The shell is provided with a neck seat having a through hole in communication with the hollow interior of the shell. The neck tube is lodged in the through hole of the neck seat such that the outer end of the neck tube forms with the neck seat a neck portion of the golf club head. The shell is further provided on the outer surface with an open space corresponding in shape to the ball-hitting plate. The ball-hitting plate is fused with the shell by brazing such that the ball-hitting plate covers the open space of the shell. The shell is made by casting. The neck tube is made by a mechanical process. The ball-hitting plate is made by forging, or punching and pressing.

6 Claims, 4 Drawing Sheets

HEAD OF A WOODEN GOLF CLUB

FIELD OF THE INVENTION

The present invention relates generally to a wooden golf club, and more particularly to a metal head of the wooden golf club.

BACKGROUND OF THE INVENTION

The conventional wooden golf club head is of a hollow construction and is formed of two or three shells which are fused together by soldering. Such as Japan Patent 63-154186, 5-317466 and 309833. Such conventional wooden golf club head is susceptible to deformation. Another conventional wooden golf club head, as illustrated in FIG. 1, is formed of a hollow shelled body 91 which is integrally made by dewaxing and casting. The shelled body 91 is provided with a front space 93, and a ball-hitting plate 92 fused to the front space 93 by soldering. In light of the shelled body 91 being formed by single casting, the shelled body 91 is not apt to deform. However, the shelled body 91 has an extension pillar 95 located in the interior of the shelled body 91 such that the extension pillar 95 is corresponding in location to the neck 94, and that the extension pillar 95 is fastened with one end of the shaft. In the process of making the shelled body 91 by casting, the residue of the sintered cast sand or metal lump is deposited in the hard-to-reach comers between the extension pillar 95 and the shell wall and can not be easily removed. The residue gives an added weight to the head, thereby undermining the precision of the golf club head.

SUMMARY OF THE INVENTION

The primary objective of the present invention is to provide a golf club head which is not susceptible to deformation and is weighted with precision.

The golf club head of the present invention comprises a shell, a neck tube, and a ball-hitting plate. The shell is hollow and made of metal by casting. The shell is shaped like a golf club head and is provided with a heel portion, a toe portion, a top portion, a sole portion, a back portion, and an open space corresponding in location to the face of the golf club head. The top portion is provided with a neck seat corresponding in location to the heel portion and having a through hole in communication with the hollow interior of the shell. The neck tube is provided with a fastening hole extending along the direction of the longitudinal axis of the neck tube. The ball-hitting plate is made of metal by forging, or punching and pressing. The ball-hitting plate has a profile corresponding to the shape of the open space of the shell. The ball-hitting plate is fused to the open space by soldering.

DETAILED DESCRIPTION OF THE INVENTION

Figure 1:
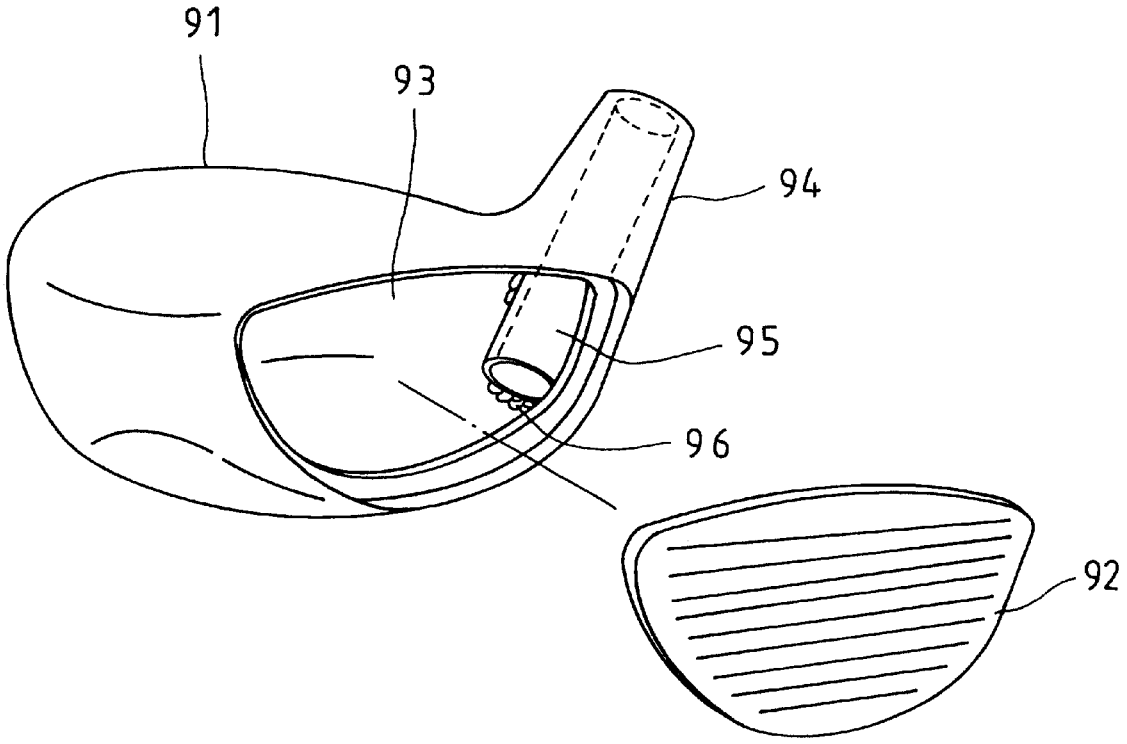
FIG. 1 PRIOR ART
FIG. 1 shows a schematic view of a golf club head of the prior art.
Figure 2:
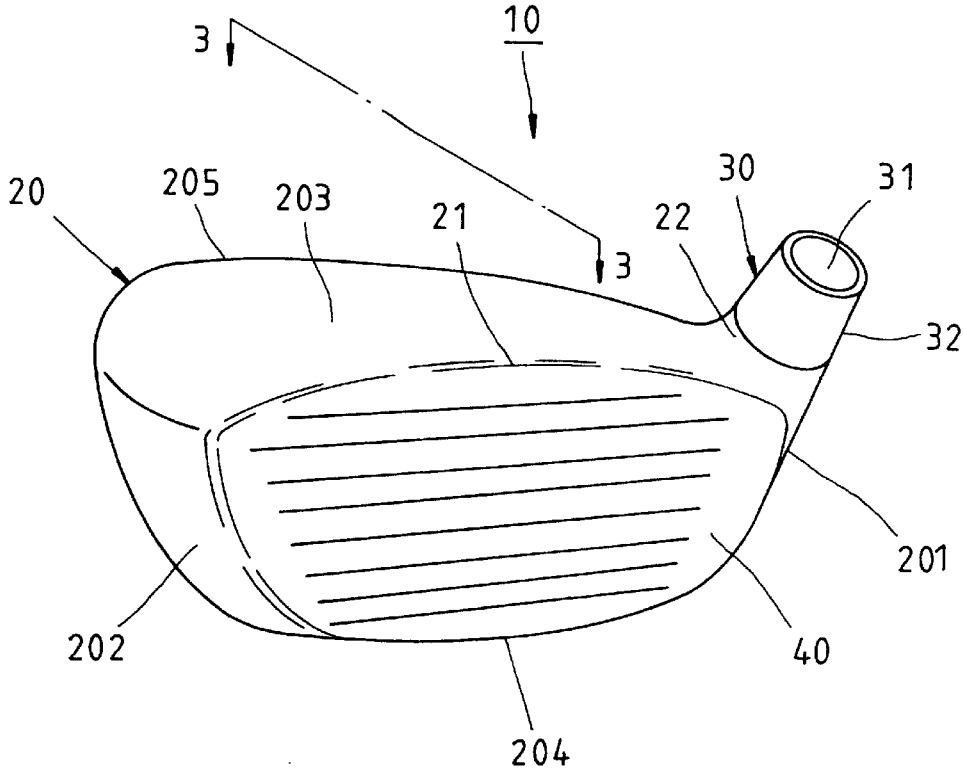
FIGS. 2–4 show schematic views of a first preferred embodiment of the present invention.
Figure 3:
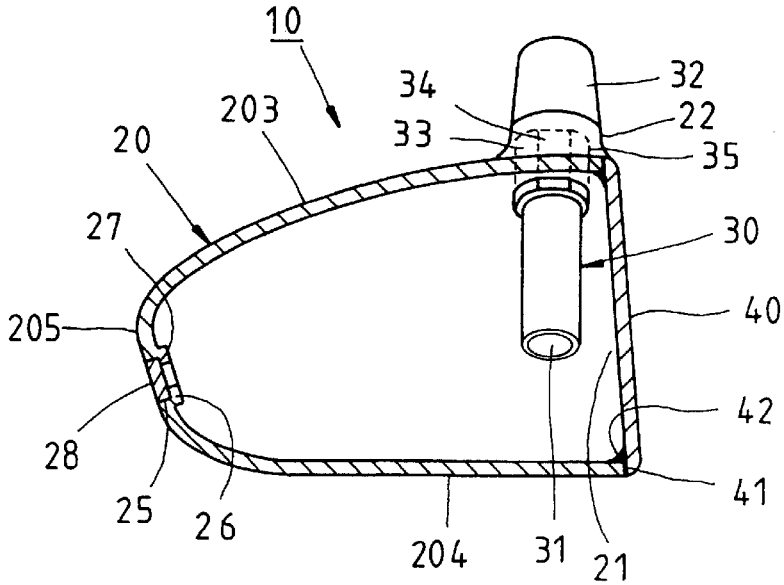
Figure 4:
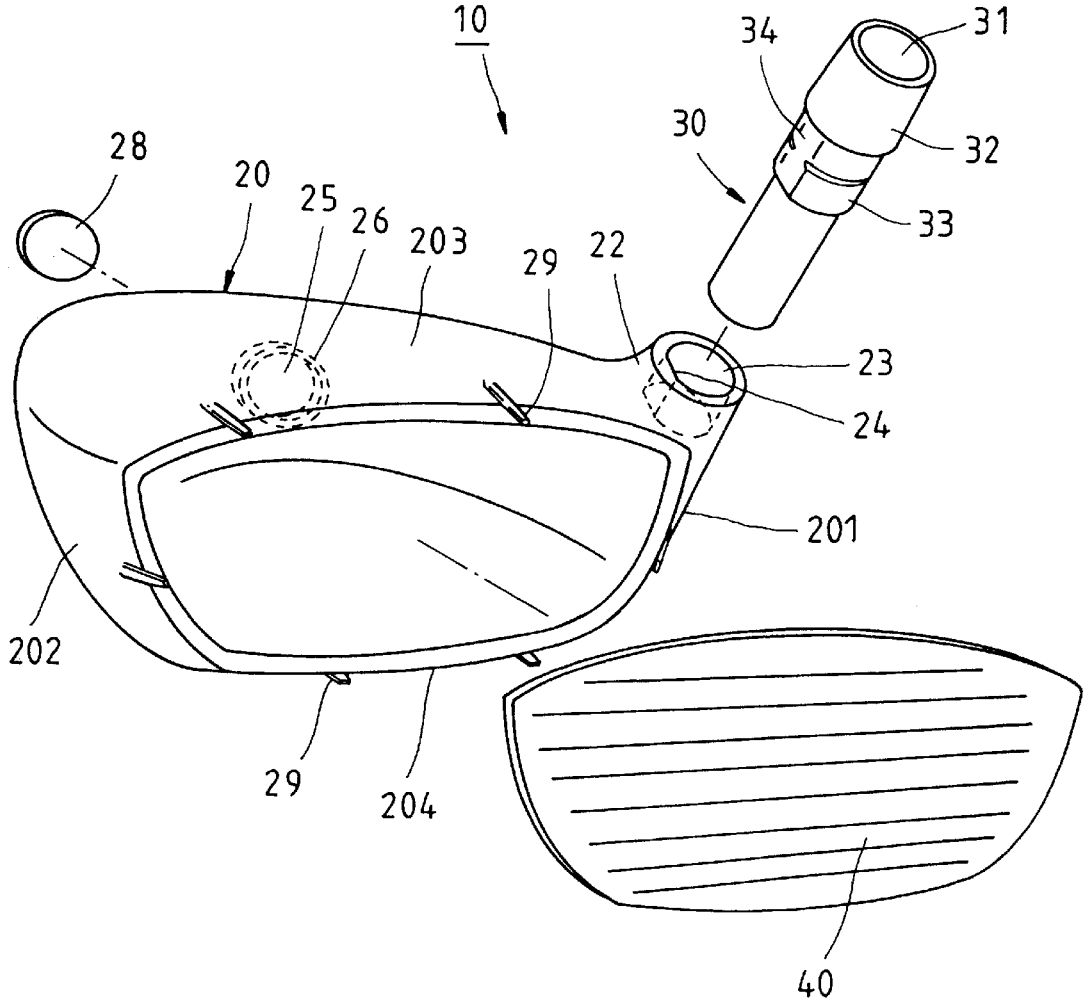

As shown in FIGS. 2–4, a golf club head 10 embodied in the present invention is formed of a shell 20, a neck tube 30, and a ball-hitting plate 40.

The shell 20 is integrally made of stainless steel by dewaxing and casting and is shaped like the golf club head. The shell 20 is provided with a hollow interior, and in the outer surface thereof with a heel portion 201, a toe portion 202, a top portion 203, a sole portion 204, a back portion 205, and an open space 21 corresponding in location to the front face portion of a golf club head. The top portion 203 is provided with a cylindrical neck seat 22 corresponding in location to the heel portion 201 and having a through hole 23 in communication with the hollow interior of the shell 20. The through hole 23 has a round cross section, and an inner wall which is provided in one side thereof with a planar surface 34. The back portion 205 is provided in the center thereof with a through hole 25 which has an annular shoulder 27 extending outward. The shell 20 is provided in the inner wall thereof with an annular protruded edge 26 circumventing the through hole 25 which is provided with an insert 28 by brazing in such a manner that the inner side of the insert 28 is rested against the shoulder 27, and that the outer side of the insert 28 forms a part of the back portion 205 of the shell 20. The through hole 25 is formed in the casting process by a hole which is intended to rid the shell wax matrix of the sand paste. The protruded edge 26 is intended to prevent the deformation of the shell wax matrix and to form the shoulder 27.

The neck tube 30 is made of a metal material by a mechanical process and is provided with an insertion hole 31 extending throughout the radial direction of the neck tube 30. The neck tube 30 has a large diametrical end 32 which is of a conical shape and is provided with a rough inner end equal in outer diameter to the neck seat 22 of the shell 20. The neck tube 30 is provided in the midsegment with a rough connection portion 33 contiguous to the large diametrical end 32. The connection portion 33 is provided in one side with a planar surface 34, thereby enabling the connection portion 33 to have a cross section corresponding to the through hole 23 of the shell 20. The neck tube 30 is lodged in the through hole 23 of the shell 20 such that the inner end of the neck tube 30 is extended into the interior of the shell 20, and that the large diametrical end 32 is rested against the neck seat 22, and further that the connection portion 33 of the neck tube 30 is joined with the inner wall of the through hole 23 of the shell 20. The first preferred embodiment of the present invention is provided with a brazing layer 35 which is located between the connection portion 33 and the inner wall of the through hole 23. In other words, the neck tube 30 is secured to the shell 20 by the brazing layer 35 which is formed of a brazing solder, such as a silver-based solder. The neck tube 30 is prevented from swiveling aside by the planar surface 34 of the connection portion 33 of the neck tube 30 and the planar surface 24 of the through hole 23 of the shell 20. The neck tube 30 may be joined with the shell 20 by means of threads. However, the engagement direction of the threads must be so designed as to prevent the engaged threads from being disengaged by the torsional force that is brought about by the impact of a golf ball on the golf club head 10.

The ball-hitting plate 40 is made of a titanium alloy or maraging steels by brazing, or punching and pressing. The ball-hitting plate 40 is corresponding in shape to the open space 21 of the shell 20 and is slightly greater in size than the open space 21. The open space 21 is covered by the ball-hitting plate 40 by brazing such that the ball-hitting plate 40 is fused with the shell 20 by a brazing layer 41 and an annular brazing strip 42 extending along the fringe of the open space 21 and having a triangular cross section. The inclined side of the cross section of the brazing strip 42 is of an arcuate shape, with other two sides of the cross section of the brazing strip 42 being fused respectively with the shell 20 and the ball-hitting plate 40 by brazing. The brazing layer 41 and the soldering strip 42 are formed of a brazing solder. In the process of fusing the ball-hitting plate 40 with the shell 20, the ball-hitting plate 40 is located over the open space 21 of the shell 20 such that the brazing solder is applied along the contact area between the fringe of the ball-hitting plate 40 and the shell 20 before they are heated in an even. Upon being cooled, the brazing layer 41 and the brazing strip 42 are formed of the brazing solder. The neck tube 30, the ball-hitting plate 40, and even the insert 28 are all fused with the shall 22 at the same time by the brazing solder.

The insertion hole 31 of the neck tube 30 is intended to facilitate the fastening of one end of a shaft with the head 10. In light of the shell 20 of the present invention being made by single casting, the shell 20 has a stable shape and a thickness ranging between 0.5 and 0.9 mm. As a result, the golf club head 10 of the present invention is greater in volume than the conventional golf club heads which are equal in weight to the golf club head 10 of the present invention. The golf club head 10 of the present invention has a relatively greater inertia and sweet spot. In addition, the weight precision of the golf club head 10 can be better controlled by virtue of the fact that the present invention is free from the problem of the deposit of the casting sand or the metal residue in the shell 20.

As shown in FIG. 4, the inner side of the ball-hitting plate 40 is attached to the shell 20. Before they are fused by brazing, they are temporarily located by a plurality of locating strips 29 circumventing the open space 21 of the shell 20. The ends of the locating strips 29 are hooked to catch the edge of the ball-hitting plate 40. Upon completion of the brazing, the locating strips 29 are stripped.

Figure 5:
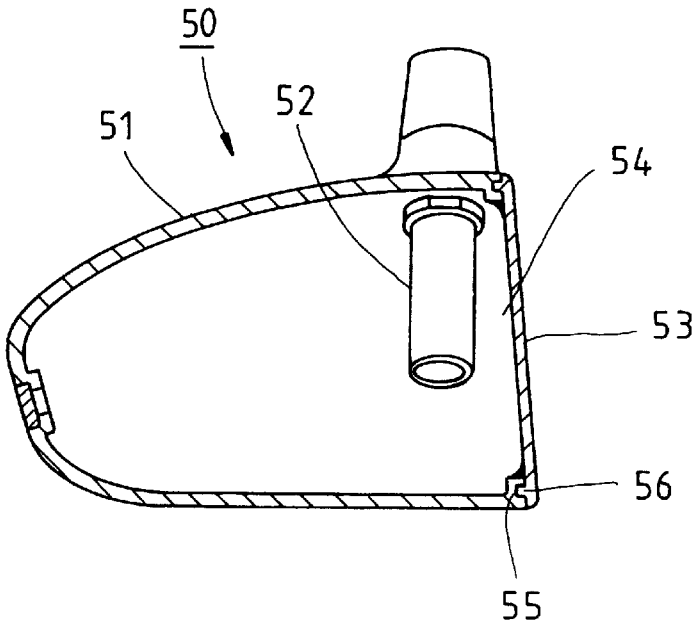
FIGS. 5 and 6 show schematic views of a second preferred embodiment of the present invention.
Figure 6:
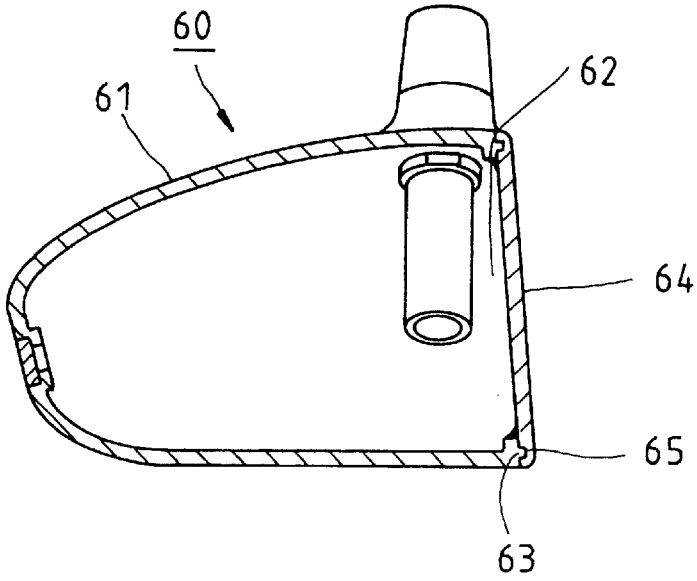

As shown in FIG. 5, a golf club head 50 of the second preferred embodiment of the present invention comprises a shell 51, a neck tube 52, and a ball-hitting plate 53. The golf club head 50 is different from the golf club head 10 in design in that the shell 51 is provided with an open space 54 and an annular groove 55 circumventing the open space 54, and that the underside of the ball-hitting plate 53 is provided along the fringe thereof with an annular protruded strip 56. The ball-hitting plate 53 can be thus located temporarily on the shell 51 by the annular protruded strip 56 which is received in the annular groove 55 of the shell 51 without the use of the locating strips 29 of the first preferred embodiment of the present invention. As shown in FIG. 6, the shell 61 is provided with an annular protruded strip 63 circumventing the open space 62, whereas the underside of the ball-hitting plate 64 is provided along the fringe thereof with an annular groove 65 for receiving the annular protruded strip 63 so as to locate temporarily the ball-hitting plate 64 on the shell 61.

What is claimed is:

1. A golf club head comprising:

a hollow shell made of metal by casting and provided on an outer surface with a heel portion, a toe portion, a top portion, a sole portion, a back portion, an open space, and a neck seat located in said top portion and corresponding in location to said heel potion, said neck seat provided with a through hole in communication with a hollow interior of said shell;

a neck tube made of a metal material by a mechanical process and lodged in said through hole of said neck seat such that an inner end of said neck tube is extended into said hollow interior of said shell, and that an outer end of said neck tube projects out of said shell to form with said neck seat a neck portion of the golf club head whereby said neck tube is provided with an insertion hole extending along the direction of a longitudinal axis of said neck tube;

a ball-hitting plate made of metal by forging, or punching and pressing, said ball-hitting plate corresponding in shape to said open space of said shell whereby said ball-hitting plate is fused with said shell by brazing such that said open space of said shell is covered by said ball-hitting plate;

wherein said through hole of said shell has a round cross section and is provided in an inner wall thereof with a planar surface; and wherein said neck tube has a portion which is corresponding in cross sectional profile to said through hole and is received securely in said through hole; and wherein said through hole of said shell is provided in an inner wall thereof with a brazing layer fusing said neck tube with said shell.

2. The golf club head as defined in claim 1, wherein said neck seat is of a cylindrical construction; wherein said outer end of said neck tube has a large conical portion pressing against said neck seat, said inner end of said neck tube being equal in outer diameter to said neck seat.

3. The golf club head as defined in claim 1, wherein said shell is provided with an annular groove circumventing said open space; wherein said ball-hitting plate is provided in an underside thereof with an annular strip whereby said ball-hitting plate is fused with said shell by brazing such that said ball-hitting plate covers said open space, and that said annular strip of said ball-hitting plate is received in said annular groove of said shell.

4. The golf club head as defined in claim 1, wherein said shell is provided with an annular strip circumventing said open space; wherein said ball-hitting plate is provided in an underside thereof with an annular groove whereby said ball-hitting plate is fused with said shell by brazing such that said ball-hitting plate covers said open space, and that said annular strip of said shell is securely received in said annular groove of said ball-hitting plate.

5. The golf club head as defined in claim 1, wherein said ball-hitting plate is fused with said shell by a brazing layer; wherein said shell is provided with a brazing strip circumventing said open space of said shell and having a triangular cross section, with one inclined side of the triangular cross section being arcuate in shape, with other two sides of the triangular cross section being fused respectively with said shell and said ball-hitting plate by brazing.

6. The golf club head as defined in claim 1, wherein said back portion of said shell has a through hole, and an insert fused with said through hole by brazing.

* * * * *